United States Patent [19]

Kim et al.

[11] Patent Number: 4,691,399

[45] Date of Patent: Sep. 8, 1987

[54] REHABILITATION OF STEEL TRUSS BRIDGES BY MEANS OF REINFORCING ARCHES

[76] Inventors: Jai B. Kim, Federal Building, Lewisburg, Pa. 17837; John M. Yadlosky, 281 Thompsonville Rd., McMurray, Pa. 15317

[21] Appl. No.: 800,300

[22] Filed: Nov. 21, 1985

[51] Int. Cl.[4] ..... E01D 1/00

[52] U.S. Cl. ..... 14/2; 14/25; 14/10; 52/514

[58] Field of Search ..... 14/1–6, 14/9, 10, 13–15, 21, 24–26; 52/514, 174

[56] References Cited

U.S. PATENT DOCUMENTS

| | | | |
|---|---|---|---|
| 1,192 | 6/1839 | Wilton | 14/2 |
| 1,685 | 7/1840 | Howe | 14/2 |
| 6,126 | 2/1849 | Steele | 14/2 |
| 8,280 | 6/1851 | McDonald | 14/2 |
| 31,415 | 2/1861 | Story | 14/2 |
| 35,381 | 5/1862 | McGuffie | 14/2 |
| 391,463 | 11/1888 | Ellis | 14/24 |
| 536,680 | 4/1895 | Avery | 14/4 |
| 566,233 | 8/1896 | Semmes | 14/4 |
| 1,344,646 | 6/1920 | Needs | 14/2 |
| 2,329,906 | 9/1943 | Inglis | 14/13 |
| 2,417,825 | 3/1947 | Janke, Sr. | 14/3 |

OTHER PUBLICATIONS

Engineering News Record, Jun. 10, 1982, "Truss Bridges Get New Life" and Find Way to Renew Spans.
Public Works, Oct., 1983, "First Use of Low-Cost Bridge Strengthening Design", pp. 57, 58.
Modern Steel Construction, "Century-Old Truss Bridge in Pennsylvania", First Quarter, 1984.
Engineering News Record, "Railroad Bridges Reinforced in Brazil", Dec. 2, 1943, pp. 84–85.

*Primary Examiner*—Stephen J. Novosad
*Assistant Examiner*—John R. Letchford
*Attorney, Agent, or Firm*—Holman & Stern

[57] ABSTRACT

The useful life and carrying capacity of an existing steel truss bridge are increased by adding a support arch assembly secured to the truss structure. In the preferred embodiment the support arch structure assembly includes arch members running along each side of the bridge. Each arch member includes two spaced arch sections, each arch section including end-to-end beams, preferably channel beams, forming an arcuate path. The web portions of the arch beams are secured to hangers of the truss structure, one arch section extending on the inboard side of the hangers, the other section extending on the outboard side. Additional floor beams may be added, along with corresponding additional hangers which can be secured to the arch beams. The support arch assemblies may be post-tensioned by tension bars connected between opposite ends thereof.

19 Claims, 10 Drawing Figures

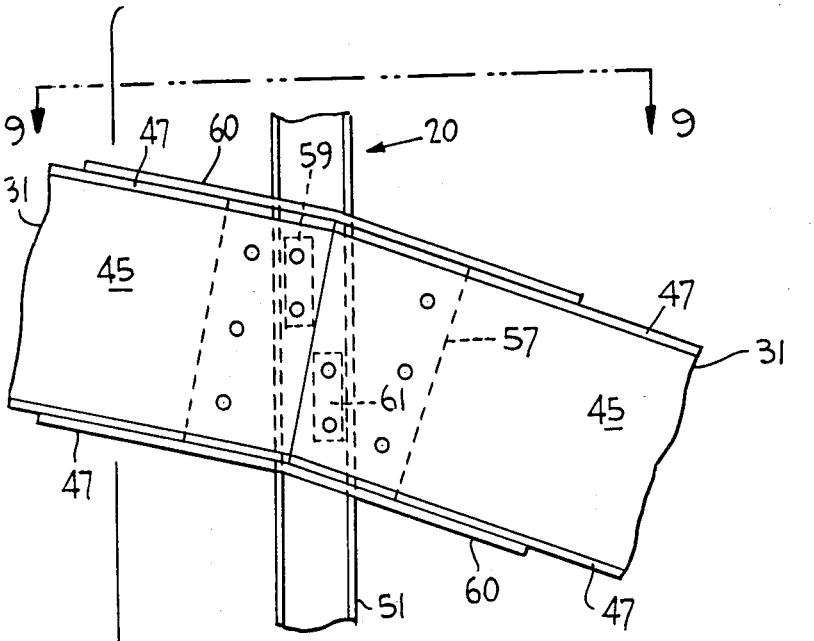
FIG. 8
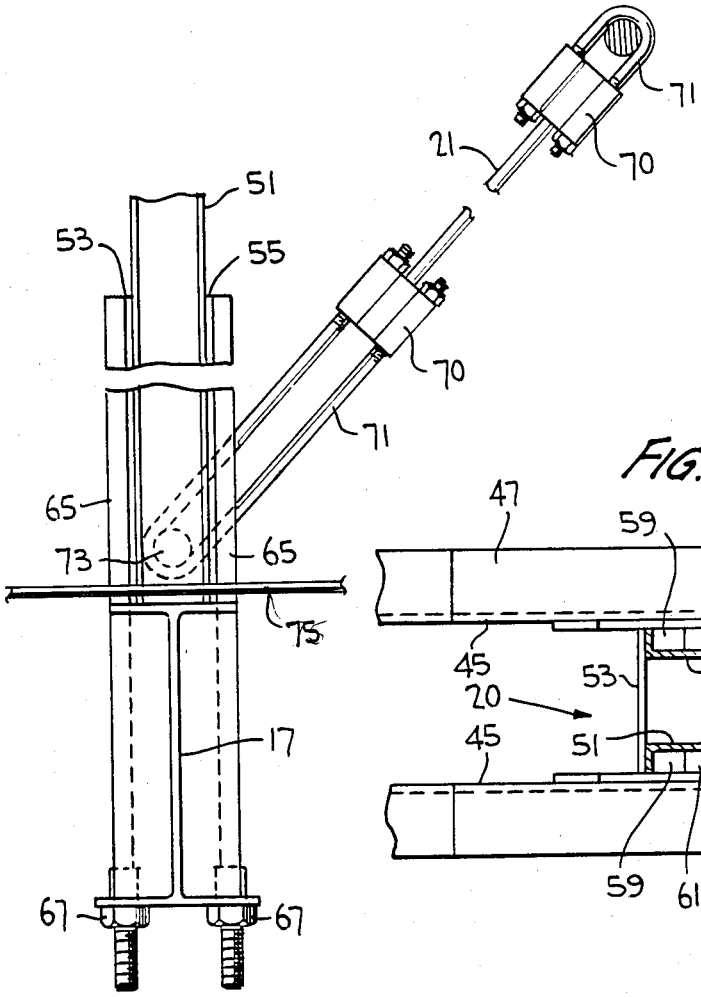
FIG. 9
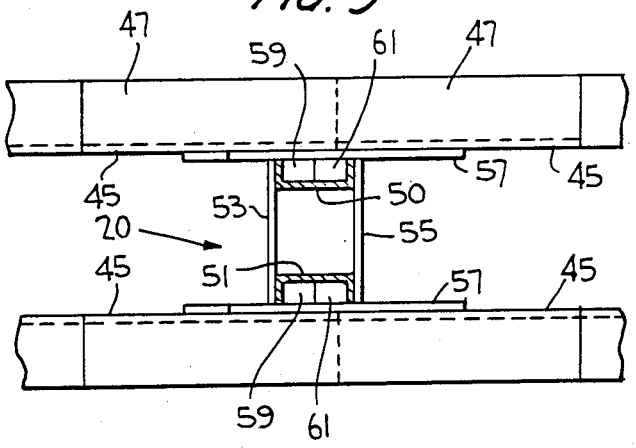

REHABILITATION OF STEEL TRUSS BRIDGES BY MEANS OF REINFORCING ARCHES

BACKGROUND OF THE INVENTION

1. Technical Field

The present invention relates to the structural support of bridges and, more particularly, to a method and apparatus for reinforcing existing steel truss bridges.

2. Discussion of the Prior Art

Many bridge structures in the world today are in desperate need of repair and structural reinforcement to support today's vehicle loads. In the usual approach to repair and rehabilitation of bridges, an attempt is made to strengthen the weakest link or links in order to restore the carrying capacity of the origial structure. However, that carrying capacity is often less than present traffic demands warrant. Other approaches require major structural additions to bridges; however these usually require that the bridge be closed to traffic, thereby disrupting normal, and sometimes crucial, traffic patterns. In addition, conventional techniques for reinforcing bridges require removal of the existing structure or a considerable portion thereof, thereby necessitating the expense of shoring or jacking during repair. Moreover, conventional bridge repair techniques may add significantly considerable material to the existing structure so that the dead load of the bridge is increased considerably.

OBJECTS AND SUMMARY OF THE INVENTION

It is therefore an object of the present invention to provide a simple and inexpensive method and apparatus for increasing the useful life and carrying capacity of an existing steel truss bridge.

It is the further object of the present invention to provide a retrofit technique for steel truss bridges which increases the carrying capacity of such bridges to the point where they can be rendered serviceable for modern traffic demands.

Still another object of the present invention is to provide a method and apparatus for rehabilitating steel truss bridges such that the carrying capacity of the bridge is not only restored but is increased from its orginal capacity.

It is another object of the present invention to provide a method and apparatus for increasing the carrying capacity of an existing steel truss bridge without requiring shoring or jacking or the disruption of traffic during the modification period.

It is yet another object of the present invention to provide a method and apparatus for enhancing the carrying capacity and useful life of a steel truss bridge without significantly adding to the dead load weight of the bridge.

The present invention takes advantage of the phenomenon that a light weight arch can carry a significant load if it is well supported laterally. A support arch structure is added to an existing truss bridge by securing an arch on each side of the bridge to the existing truss structure. Preferably, each arch is secured to the vertically-extended hangers which form a part of the existing truss structure. Each side of the arch comprises a support arch member having two side-by-side sections secured to the inboard and outboard sides, respectfully, of the hangers. Each arch section includes a plurality of end-to-end beams, preferably channel beams, formed in an arcuate path defining the arch. As part of the bridge modification, additional bridge floor beams may be added along with additional hangers to which the arch sections are secured for additional support.

By simply adding the arch members, the carrying capacity of the entire truss bridge structure is considerably upgraded, thereby permitting an increase in the live load carried by the bridge. In addition, the arch may be added without disrupting traffic and without requiring removal of parts of the existing structure so that there is no need for temporary shoring and jacking. We have found that the additional weight of the arch is sufficiently small so as to increase the dead load on the bridge by approximately 16%.

The invention also includes the step of post-tensioning the arches per se, or both the arches and the existing truss so that dead load stresses in the existing truss members will be reduced. In order to support the weight of arches while they are installed in short sections without overloading the existing truss and also to reduce the number and amount of repairs and strengthening of existing truss members necessary to increase the load carrying capacity, post-tensioning is recommended for the reduction of stresses in the truss members and also for making the arches more effective in their load carrying capacity. Post-tensioning is also recommended if the bridge ends cannot resist the arches' horizontal thrust forces as in tall, slender bridge piers, or if the bridge abutments might move, because the arch ends must remain fixed permanently after arches are installed.

The invention may further include adding floorbeams and hangers midway between existing floorbeams, replacing or reinforcing existing floorbeams if they are deteriorated or overloaded, connecting the existing vertical members, which now act as hangers, to the arches and to the existing floorbeams or replaced floorbeams, (this new connection bypasses all of the lower chord joints/connections, pinned or riveted), and adding stringers, if needed.

The invention may exhibit one or more of the following results:

Considerably reduced costs, compared with bridge replacement costs, the reinforcing system can be designed to increase the load carrying capacity to any desired level so that from the stand point of structural safety, the bridge will be new; by reducing the span of the stringers, the stresses in the floor system are sufficiently reduced so that in many cases the floor and stringers need not be involved in the rehabilitation; this system makes it possible to have little, if any, interruption of traffic during the rehabilitation; in contrast to replacement bridges, the rehabilitated bridge involves no additional encroachment on the waterway or changing of the approaches to accommodate a higher roadway elevation; a short construction period—the erection of a typical span will take 2 to 3 weeks, and traffic can be maintained throughout that period; critical pin connections in the bottom chords are completely bypassed so that they are much less likely to fail, by fatigue or other causes, and also failure of such connection will not affect the overall integrity of the bridge; because of the post-tension system, movements at abutments or bending of tall, slender piers will not affect the integrity of the arch/truss reiforcing action.

BRIEF DESCRIPTION OF THE DRAWINGS

These and other objects, features and many of the attendant advantages of the invention will be better understood upon a reading of the following detailed description when considered in conection with the accompanying drawings wherein like parts in each of the several figures are identified by the same reference numerals, and wherein:

FIG. 8 is a broken detailed view in elevation of a portion of the modified bridge structure of FIG. 5;

FIG. 9 is a view taken along lines 9—9 of FIG. 8;

DESCRIPTION OF THE PREFERRED EMBODIMENTS

Figure 1:
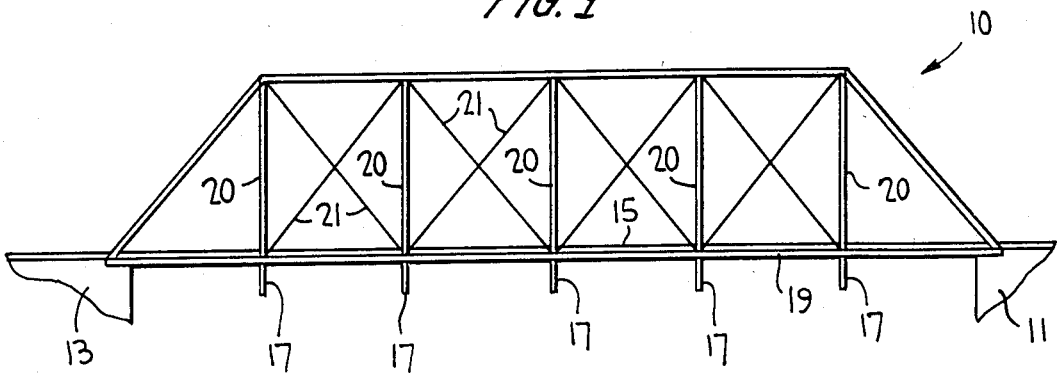
FIG. 1 is a diagramatic view in elevation of an existing truss bridge to be modified in accordance with the present invention.

Referring specifically to FIG. 1 of the accompanying drawings, an existing truss bridge 10 is shown extending longitudinally across a span between members 11 and 13. In the view illustrated in FIG. 1, the truss support structure is shown as including a floor 15 supported above a plurality of spaced transversely extending floor beams 17. A plurality of longitudinally-extending stringers 19 rest atop the floor beams 17 and support the bridge floor 15. The truss structure further includes a plurality of hangers 20 which are in the form of vertically-extending members which extend upwardly from the floor beams 17 at opposite sides of the bridge. The hangers 20 are substantially parallel to one another and serve as connecting points in the truss for diagonal support rods 21 and the horizontally-extending longitudinal and transverse support members.

Figure 2:
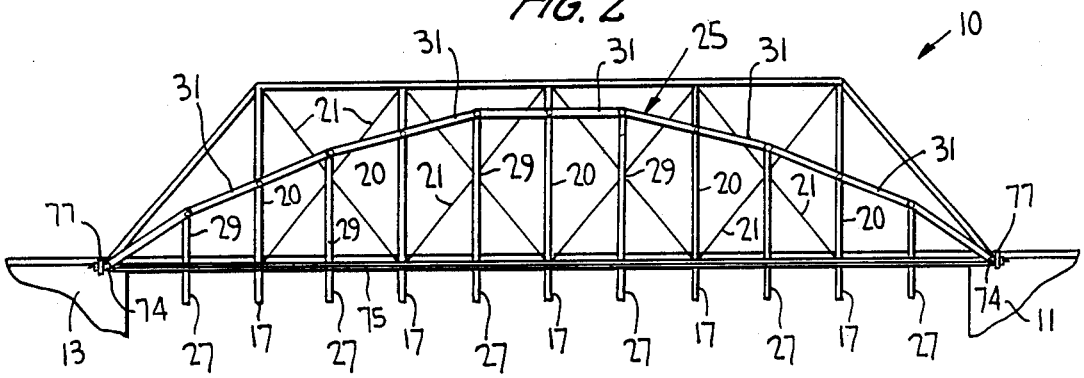
FIG. 2 is a view similar to FIG. 1 showing the existing truss bridge modified by means of a support arch.
Figure 3:
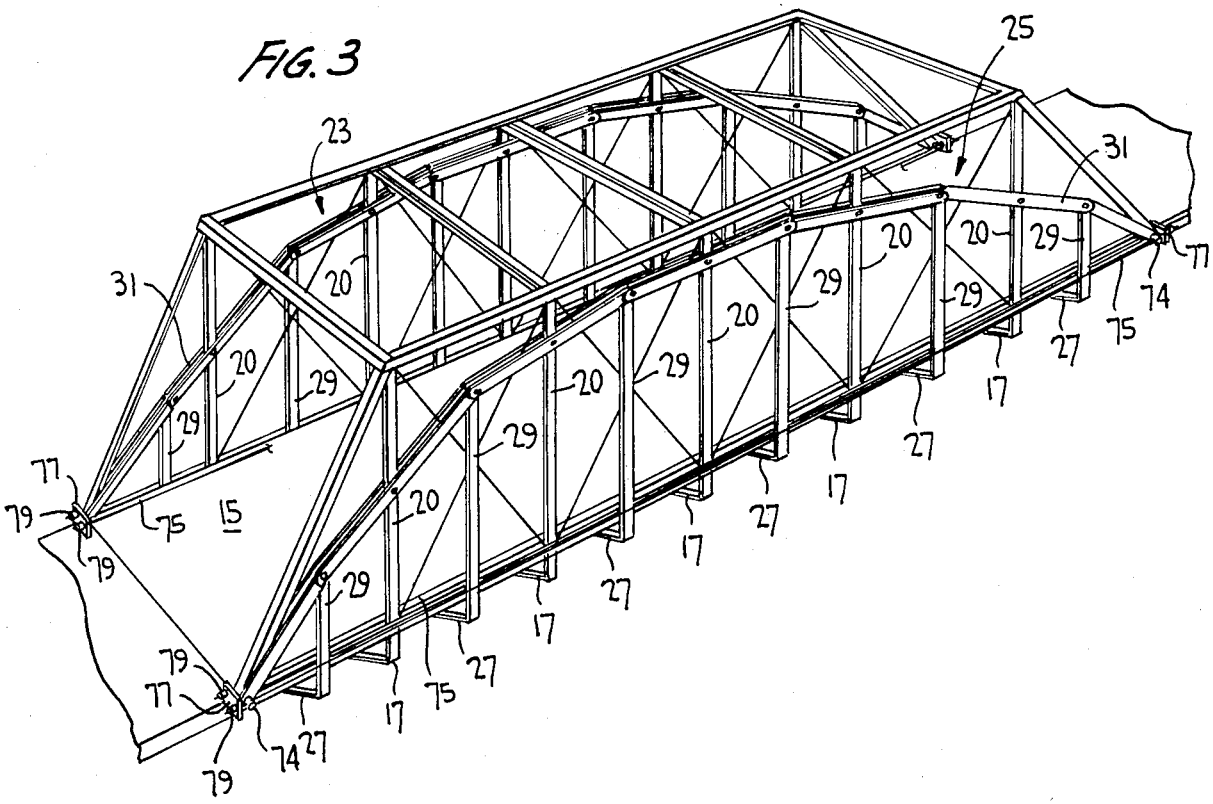
FIG. 3 is a view in perspective of the bridge of FIG. 2.
Figure 4:
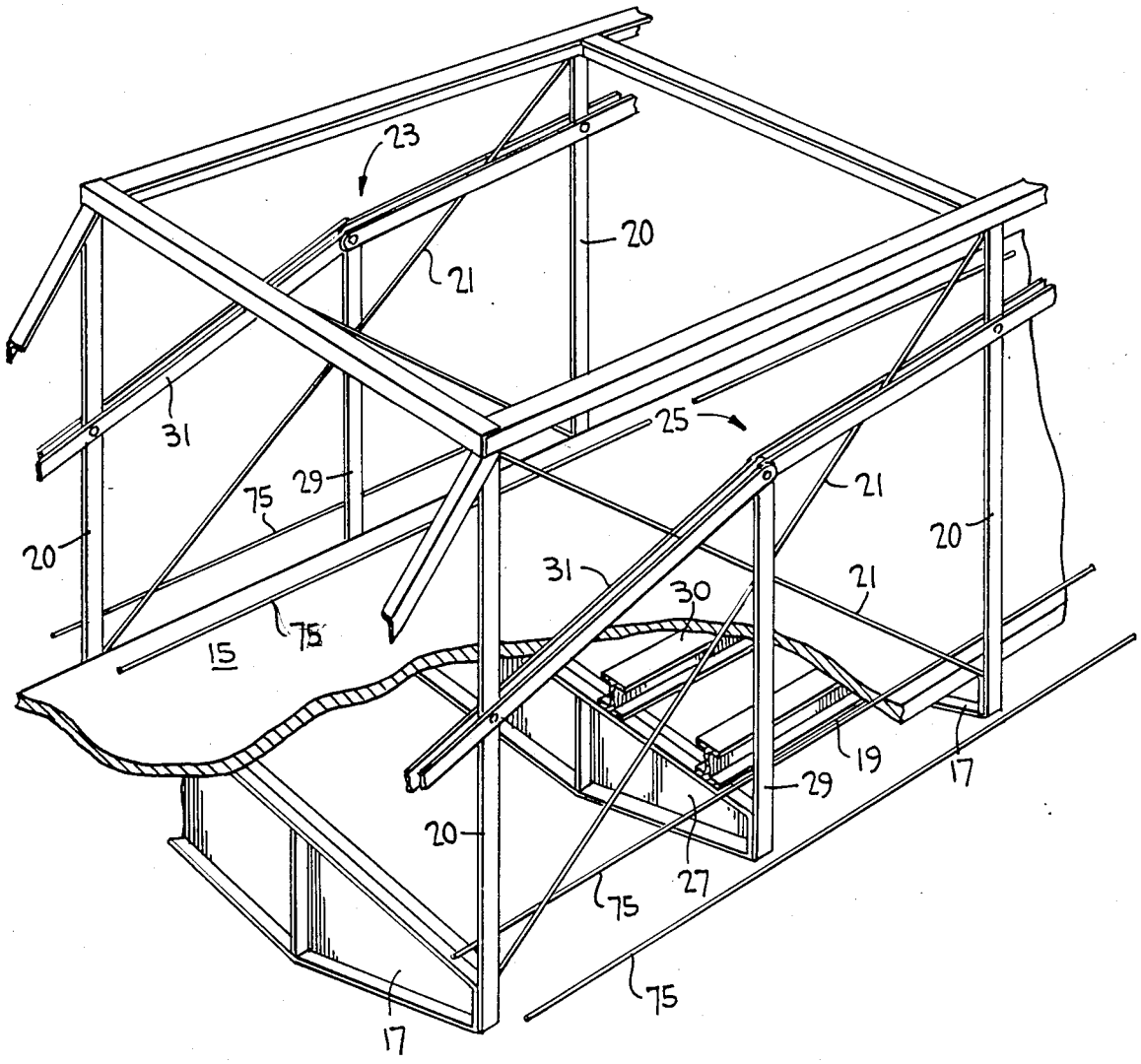
FIG. 4 is a partially broken detailed view in perspective of a portion of the bridge in FIGS. 2 and 3.

Referring to FIGS. 2–4 of the accompanying drawings, in accordance with the present invention, the useful life and carrying capacity of truss bridge 10 is increased by adding a pair of support arch members 23 and 25 which are provided along opposite transverse sides of the bridge and are secured to the existing vertically-extending hangers 20. In addition, and as preferred in accordance with the present invention, the modification of the existing truss bridge also includes the addition of new floor beams 27 which, in the illustrated embodiment, are interspersed between the existing floor beams 17 and extend parallel thereto. Additional or new hangers 29 extend vertically from the new floor beams 27 and are secured to the arch members 23 and 25. The additional floor beams 27 and additional hangers 29 serve two distinct functions. Specifically, floor systems for many existing truss bridges are badly deteriorated and are under-designed and unreliable for modern usage. Therefore, the extra floor beams 27 reduce the load on stringers 19 and existing floor beams 17. The more uniform one makes the load distribution, the more efficient the arch becomes in carrying the load. Therefore, additional floor beams provide more points by which the load can be transmitted to the arch more uniformly.

In addition to adding floor beams 27 and hangers 29 as part of the modification, additional stringers 30 (see FIG. 4) may be added between existing stringers 19.

The arch members 23 and 25 are each made up of a series of end-to-end beams 31 which interconnect at a slight angle to permit the arcuate support arch structure to be attained. In the embodiment illustrated in FIGS. 2 to 4 each beam 31 is actually two laterally or transversely spaced beams disposed on opposite sides of the hangers 20 and 29. Specifically, each hanger 20, 29 has an outboard (i.e. outwardly facing) surface or side and an inboard (i.e. inwardly facing) surface or side. The two beams which comprise each beam 31 are disposed so that one connects to the outboard side of each hanger 20, 29 and the other connects to the inboard side of each hanger 20,29.

The modification described with respect to FIGS. 2–4 relies on the fact that a light weight arch can carry a significant load if it is properly laterally supported. In the modification, the truss provides the lateral support while the arch provides the additional load-carrying capacity to render the bridge useful for modern day traffic. Tests on a bridge modified in accordance with the principles of the present invention have proven that relatively slender arch members contribute significantly improved stiffness support to the truss as well as inreasing the live load carrying capabilities significantly.

Figure 5:
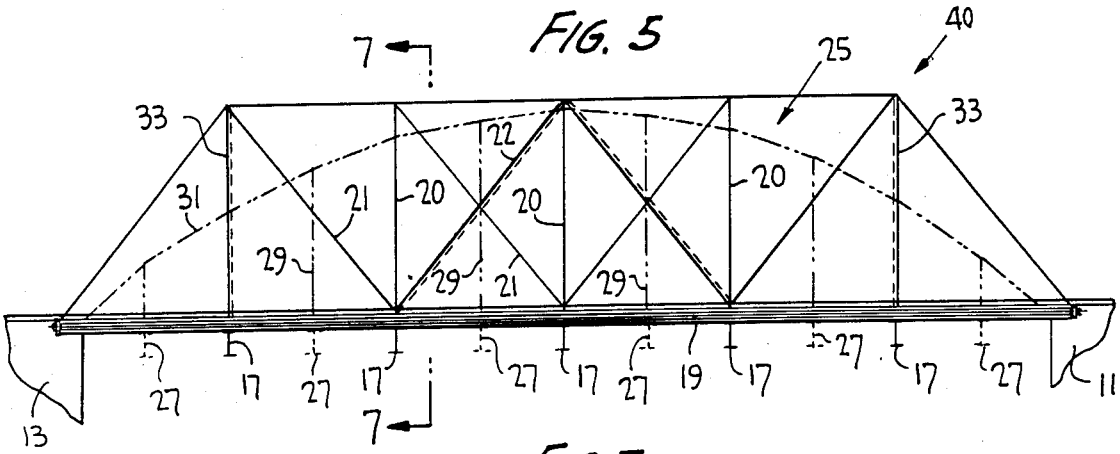
FIG. 5 is a diagramatic view in elevation of another embodiment of the modified bridge structure of the present invention.

A preferred embodiment of the present invention is illustrated in greater detail in FIGS. 5–9 of the accompanying drawings to which reference is now made. In FIG. 5, the solid line beams and bars represent members of the existing bridge 40, prior to modification. The dashed line beams and bars represent members which are added as part of the modification of the present invention. The elements illustrated in FIGS. 5–9 bear the same reference numerals as corresponding components and elements in FIGS. 1–4. The FIG. 5 embodiment differs from that of FIG. 2 primarily in that the original hangers 20 located at the opposite longitudinal ends of the structure are replaced with new hangers 33. This is an option and indicates that existing hangars may, in fact, be relaced as part of the modification, if necessary. In addition, certain of the original diagonal support bars 21 are replaced by new bars 22, or in some cases new bars 22 are added where none previously existed, as part of the modification in FIG. 5.

Figure 6:
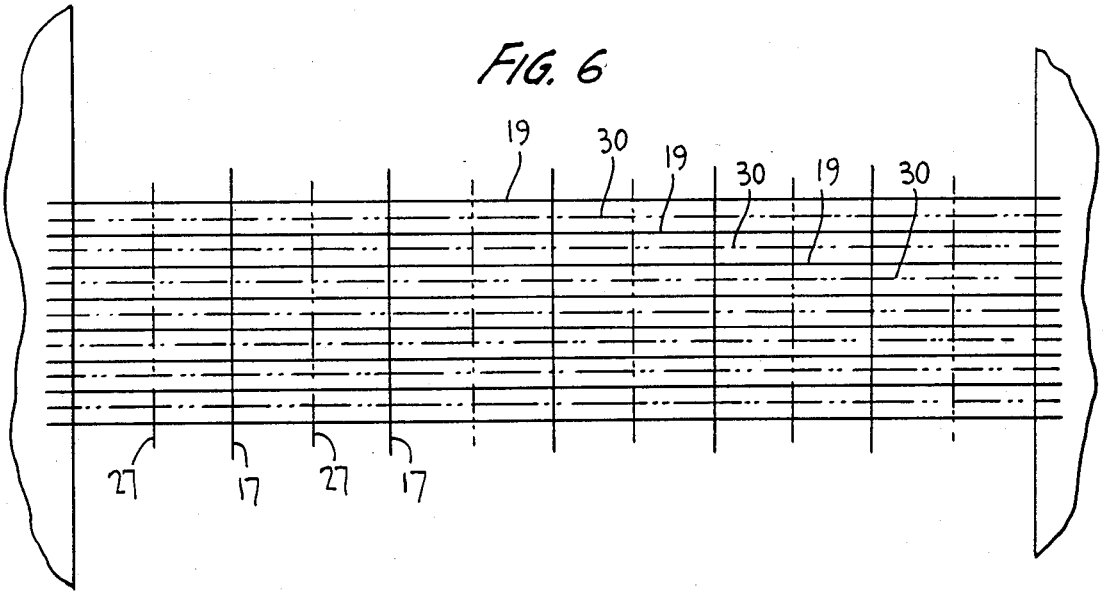
FIG. 6 is a diagramatic illustration of the layout of stringers and floor beams in the bridge of FIG. 5.

In FIG. 6 the interrelationship between existing stringers 19, new stringers 30, existing floor beams 17 and new floor beams 27 is illustrated. It is to be stressed that the added stringers 30 and added floor beams 27 may represent stringers and beams in addition to those originally provided as part of the bridge and, in some cases, may represent replacements of existing stringers and beams.

Figure 7:
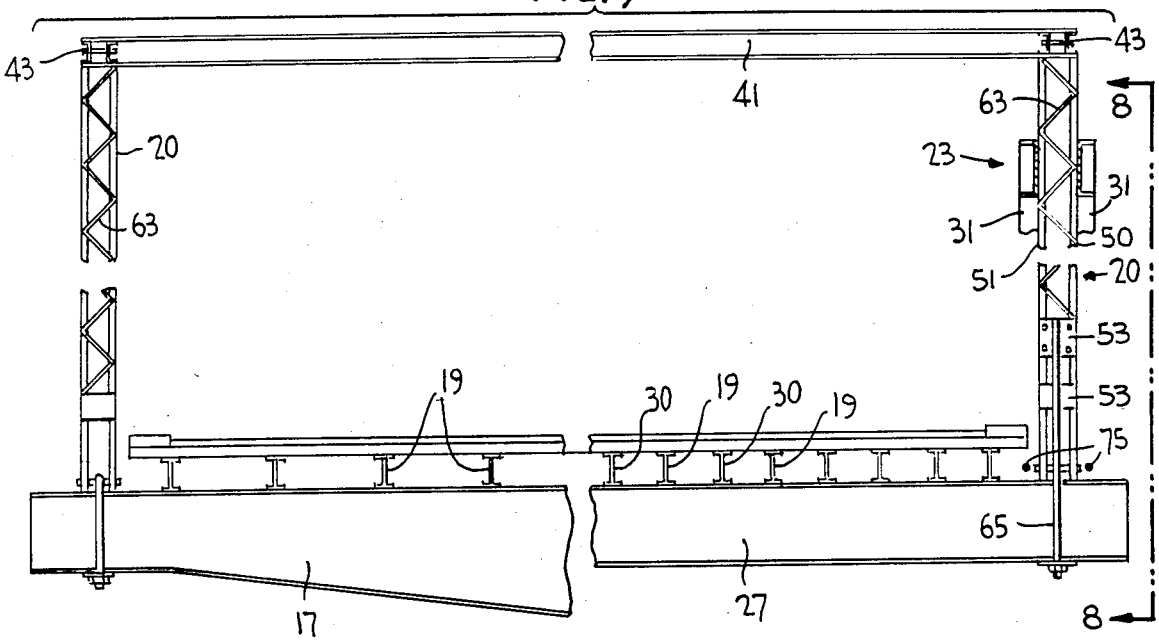
FIG. 7 is a view taken along lines 7—7 of FIG. 5.

The view in FIG. 7 represents the pre-existing bridge structure on the left hand side of the drawing and the modified structure on the right hand side of the drawing. It is seen that the arch member 23 is generally represented by the reference numeral 23 in FIG. 7 and that a pre-existing transverse support member 41 extends between each pair of hangers 20 and is connected to main support pins 43 at the top of these hangers. The difference in configuration between floor beams 17 and 27 is provided to indicate that different configuration beams may be employed, if desired or necessary, for the new floor beams.

The structural connections between the support arch member 23, hanger 20, and floor beam 17, 27 is illustrated in FIGS. 7–9 to which specific reference is now made.

The beams employed for the arch members 23, 25 in the embodiment to FIGS. 5–9 are channel beams, each of which includes a web section 45 extended between two flange sections 47 which extend perpendicularly in one direction from web section 45. Hanger 20 comprises two longitudinally extended channel beams 50 and 51 which are oriented in parallel spaced relation with their webs facing one another. The spaced channel beams 50 and 51 are joined periodically along their lengths by means of bracket plates 53 and 55 which are bolted to respective flange portions of channel beams 50 and 51. The web portion 45 of each arch support beam is secured to each hangar 20 along the open side of a respective channel beam 50 and 51 by means of respective mounting plates 57. Specifically, the flange edges for hanger channel beams 50, 51 abut one side of bracket plate 57, the other side of which is flush against the webs 45 of two end-to-end arch beams. Spacer blocks 59, 61 are disposed within each channel beam, 50, 51 in the vicinity of the point of attachment of the arch beams such that rivets, bolts, or similar attachments means may be extended through the web of channel beam 50, 51, a respective spacer block 59, 61 and the web portion 45 of the arch beam. A pair of bracket plates 60 are secured along the outside of flange portions 47 of the end-to-end arch channel beams to secure the beams in end-to-end relation. The attachment of the plates 60 to the arch channel beams may be by welding, riveting, bolts, etc. As illustrated in FIG. 7, the two channel beams 50, 51 which make up each hanger 20 may, in addition to being joined together by the plates 53, 55, be interconnected and positionally stabilized by a truss-like network of bars or rods 63.

Two of the plates 53, 55 which join the channel beams 50, 51 of the hanger 20 are secured to respective bar members 65 which are threaded at their bottom end and extend through the upper most flange of a respective floor beam 17 to be threadedly engaged by a nut 67 at the underside of the bottom flange of that floor beam. In this manner the bottom of each hanger 20 is secured to the lower most flange 67 of a respective floor beam 17 and thereby held in place. The pre-existing hangers 20 are also, as described above, connected as part of the support truss of the pre-modified bridge.

As best illustrated in FIG. 8, the diagonal rods 21 have their ends secured to respective clamps 70 which receive and threadedly engage (by means of a nut, or the like) the ends of a U-bolt 71. The U-bolts 71 at opposite ends of the rod are looped about respective support pins on different hangers 20, so as to tightly interengage the various hangers. The nuts which engage respective U-bolts 71 to clamps 70 can be loosened or tightened to achieve the desired degree of tension in rods 21.

In accordance with a further significant feature of the invention, the bridge reinforcement as described above can, particularly in certain instances, as previously discussed, be made even more effective in terms of costs and structural effeciency by post-tensioning the arch structure per se, or the arch structure along with the pre-existing truss members, for example by the provision of threaded longitudinally extending post-tensioning bars anchored at the end bearings of the structure.

Figure 10:
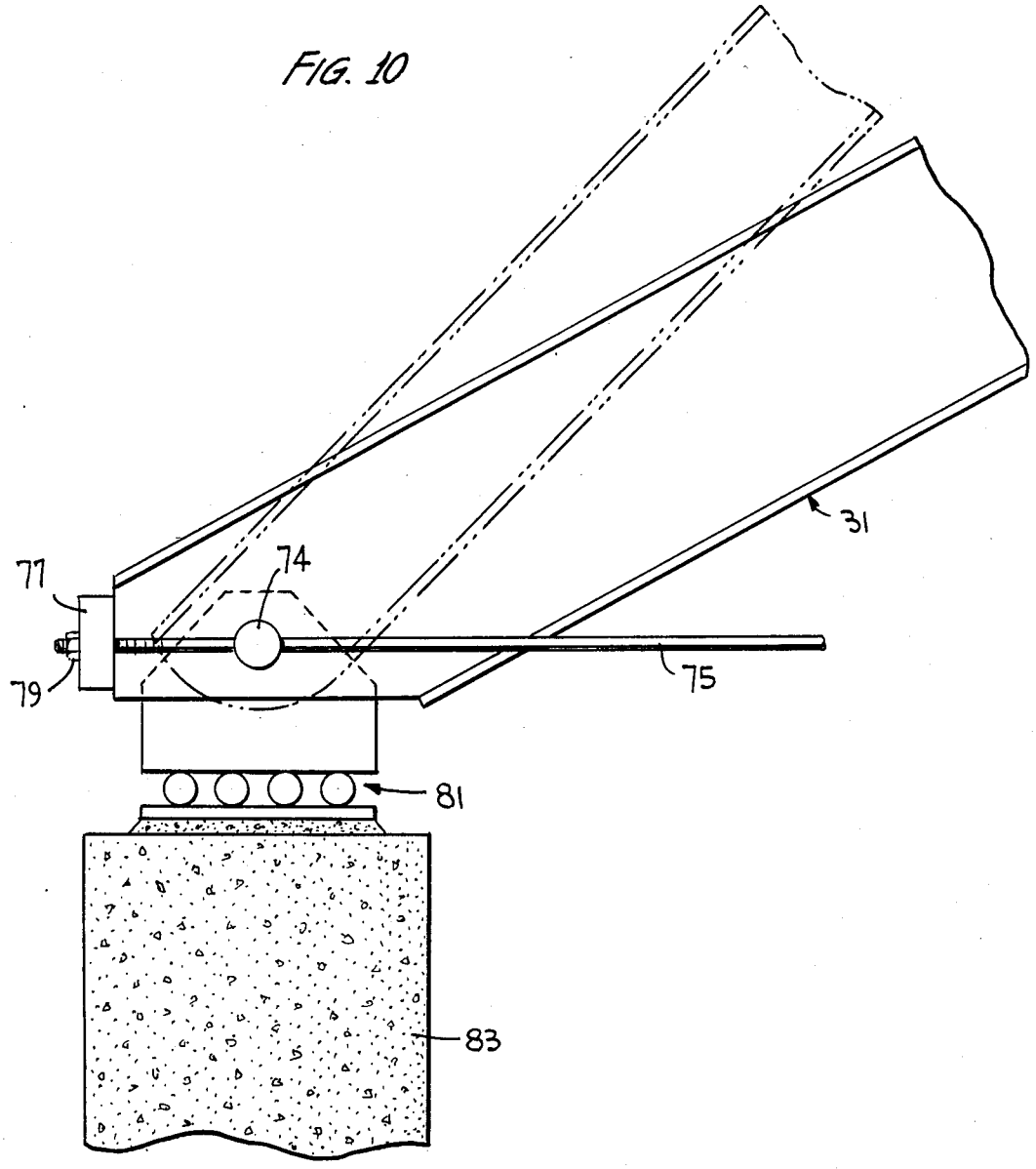
FIG. 10 is an enlarged view in elevation of one end portion of a reinforced bridge structure in accordance with the invention, showing details of a post-tensioning connection.

Thus, as shown in the drawings projecting transverse pins 74 may be provided at the corner joints of the structure attached individually to the respective support arches, or extending through the preexisting bridge trusses as well, and longitudinally extending post tensioning rods or bars 75 are connected between the respective pins, the bars extending along the lower cord lines of the reinforced truss structures. The bars are threaded at their ends, extend through tension plates 77 positioned at the respective ends of the structure and are provided with tensioning nuts 79 on the threaded ends, whereby tension is applied to the structure by tightening the nuts. FIG. 10 shows the post tensioning arrangement applied to a bridge truss mounted on an existing roller structure such as structure 81 on tall slender piers, such as pier 83.

The invention described herein makes use of the superposition of a support arch on an existing truss bridge to prevent collapse of the bridge structure under severe loading conditions. The arch structure comprises two arch members, one on either transverse side of the bridge extending longitudinally of the bridge. Each arch member includes two parallel section of end-to-end beams which, in the preferred embodiment, are channel beams. One section of each arch member is secured to the outboard side of the hangers provided for the original truss structure. The other arch section of each arch mbmer is connected to the inboard side of those hangers. Additional hangers may be provided along with additional floor beams and stringers.

It is to be understood that the particular type beams employed in the embodiments described herein represent a preferred embodiment of the invention and do not necessarily constitute the only beam configuration that may be employed.

Having described several embodiments of a new and improved technique for extending the life and loading capacity of a truss bridge in accordance with the present invention, it is believed that other modifications, variations and changes will be suggested to those skilled in the art in light of the disclosure set forth herein. It is therefore to be understood that all such variations, modifications and changes are believed to fall within the scope of the invention as defined by the appended claims.

What is claimed is:

1. The rehabilitation method of increasing the useful life and load-carrying capacity of an existing steel truss bridge which itself is capable of carrying and has carried vehicle loads, the steel truss including top and bottom members, said method comprising the steps of superimposing a pair of relatively lightweight support arches and post-tensioning members for the respective arches on the existing truss in respective vertical planes on opposite transverse sides of the bridge such that the support arches are themselves laterally supported by the existing truss, the arches extending at least partly between the top and bottom members of the truss, and using the post-tensioning members for post-tensioning at least the support arches after superimposing same on the truss.

2. The method according to claim 1 wherein the step of superimposing includes connecting the support arches to the truss at intersections between the arch and vertically-extending support members of the truss.

3. The method according to claim 1 wherein the post-tensioning step comprises connecting longitudinally extending post-tensioning bars between opposite ends of the support arches and tensioning the bars.

4. The method according to claim 1 further comprising the steps of interposing new horizontally-extending floor beams spaced between and extending parallel to existing floor beams of said bridge, and supporting said arches by adding vertically-extending hangers, each hanger being secured to a respective new floor beam and one of said support arches, said existing and new floor beams being disposed beneath the floor of the bridge and extending transversely across the bridge.

5. The method according to claim 4 wherein said bridge includes a plurality of existing horizontally-extending stringer beams extending longitudinally along said bridge beneath the bridge floor and atop the floor beams, said method further comprising the step of interposing new stringer beams spaced between and extending parallel to the existing stringer beams.

6. The method according to claim 1 wherein the step of superimposing includes, for each support arch, the steps of:

arranging a first plurality of channel beams in substantially end-to-end relation in an arcuate path extending longitudinally of said bridge, each of said first plurality of channel beams having a web section which is disposed in a vertical plane and secured to the truss;

arranging a second plurality of channel beams in substantially end-to-end relation in an arcuate path extending longitudinally of said bridge and spaced transversely from said first plurality of channel beams, each of said second plurality of channel beams having a web section disposed in spaced parallel relation to a web section of an adjacent channel beam in said first plurality and being secured to said truss.

7. The method according to claim 6 wherein the steps of arranging said first and second plurality of channel beams includes:

providing new vertical support members for each support arch; and securing the web portion of each channel beam to a respective new vertical support member.

8. The method according to claim 6 wherein the steps of arranging said first and second plurality of channel beams include securing the web portion of each channel beam to an existing vertically-extending support member of said truss.

9. The method according to claim 8 wherein the steps of arranging said first and second plurality of channel beams includes:

providing new vertical support members for each support arch; and securing the web portion of each channel beam to a respective new vertical support member.

10. The method according to claim 9 further comprising the steps of interposing new floor beams between existing floor beams beneath the bridge floor, and securing each new vertical support member to a respective new floor beam.

11. The rehabilitation method of increasing the useful life and load-carrying capacity of an existing steel truss bridge which itself is capable of carrying and has carried vehicle loads, said method comprising the steps of superimposing a pair of relatively lightweight support arches on the truss in respective vertical planes on opposite transverse sides of the bridge such that the support arches themselves laterally supported by the existing truss, and post-tensioning at least the support arches by attaching post-tensioning members to the arches after superimposing same on the truss wherein the step of superimposing includes connecting the support arches to the truss at intersections between the arch and vertically-extending support members of the truss and further including the steps of interposing new horizontally-extending floor beams spaced between and extending parallel to existing floor beams of said bridge, and additionally supporting said arches by adding vertically-extending hangers, each hanger being secured to a respective new floor beam and one of said support arches, said existing and new floor beams being disposed beneath the floor of the bridge and extending transversely across the bridge.

12. The method according to claim 11 wherein said bridge includes a plurality of existing horizontally-extending stringer beams extending longitudinally along said bridge beneath the bridge floor and atop the floor beams, said method further comprising the step of interposing new stringer beams spaced between and extending parallel to the existing stringer beams.

13. A method according to claim 12 wherein the step of superimposing includes, for each support arch, the steps of:

arranging a first plurality of channel beams in substantially end-to-end relation in an arcuate path extending longitudinally of said bridge, each of said first plurality of channel beams having a web section which is disposed in a vertical plane and secured to the truss;

arranging a second plurality of channel beams in substantially end-to-end relation in an arcuate path extending longitudinally of said bridge and spaced transversely from said first plurality of channel beams, each of said second plurality of channel beams having a web section disposed in spaced parallel relation to a web section of an adjacent channel beam in said first plurality and being secured to said truss.

14. The method according to claim 13 further comprising the step of replacing selected existing floor beams in said bridge.

15. The method according to claim 13 further comprising the step of replacing selected existing stringers in said bridge.

16. A method of increasing the useful life and carrying capacity of an existing steel truss bridge which has carried vehicle loads and of the type having a floor surface, existing floor beams beneath the floor surface extending transversely of the bridge and supporting the floor surface, existing vertically-extending support members secured proximate their lower end to respective existing floor beams, and interconnecting members connected to said existing vertically-extending support members to provide structural support for the bridge, said method comprising the steps of:

extending a first plurality of beams in substantially end-to-end relation to define a first arcuate path extending longitudinally from a location proximate the floor near one end of the bridge to a peak intermediate the ends of the bridge and back to a second location proximate the floor near the opposite end of the bridge;

securing each beam in said first plurality to an inboard side of a respective existing vertically-extending support member;

extending a second plurality of beams in substantially end-to-end relation to define a second arcuate path parallel to, coextensive with and spaced transversely from said first arcuate path;

securing each beam in said second plurality to an outboard side of a respective existing vertically-extending support member such that said first and second plurality of beams are secured to the same vertically-extending support member;

wherein said first and second plurality of beams define a support arch along one side of said bridge;

connecting bars longitudinally between opposite ends of the respective arches; and tensioning the bars so as to post-tension the arches.

17. The method according to claim 16 further comprising the steps of:

extending a third plurality of beams in substantially end-to-end relation to define a third arcuate path extending longitudinally from a location proximate the floor near one end of the bridge to a peak intermediate the ends of the bridge and back to a further location proximate the floor near the opposite end of the bridge;

securing each beam in said third plurality to an inboard side of respective existing vertically-extending support members;

extending a fourth plurality of beams in substantially end-to-end relation to define a fourth arcuate path parallel to, coextensive with and spaced transversely from said third arcute path; and securing each beam in said fourth plurality to an outboard side of the respective existing vertically-extending support members such that said third and fourth plurality of beams are secured to the same vertically-extending support members;

wherein said third and fourth plurality of beams define a further support arch along the side of said bridge opposite said one side.

18. A method of rehabilitating an existing steel truss bridge which in its existing condition is capable of carrying and has carried vehicle loads, the bridge having a steel truss including top and bottom members, and vertical posts connecting the top and bottom members said method comprising the steps of:

attaching relatively lightweight support arches to the truss in respective vertical planes on opposite transverse sides of the bridge between the top and bottom members such that the arches are braced by the existing truss to substantially increase the load carrying capacity of the bridge, said step of attaching being accomplished without disrupting vehicle traffic across the bridge;

wherein said step of attaching includes securing said support arches to the vertical posts of the truss to permit said vertical posts to serve as hangers for the support arches, and wherein the method further includes the step of post-tensioning the arches by connecting longitudinally extending bars between the opposite ends of the respective arches and tensioning the bars.

19. The method according to claim 18 further comprising the steps of;

interposing new horizontally-extending floor beams spaced between and extending parallel to existing floor beams of the truss bridge; and additionally supporting said support arches by adding vertically extending hangers disposed in alternate positions between said existing vertical posts of the truss, each added hanger being secured to a respective new floor beam and one of said support arches, said existing and new floor beams extending transversely across the bridge and being disposed beneath the floor of the bridge so as to permit the new floor beams to be added without disrupting traffic flow across the bridge.

* * * * *